US005299340A

United States Patent [19]

Moon

[11] Patent Number: 5,299,340

[45] Date of Patent: Apr. 5, 1994

[54] WATER FEEDING CONTROL METHOD OF A BOILING CLOTHES WASHING MACHINE

[75] Inventor: Kyung H. Moon, Suweon, Rep. of Korea

[73] Assignee: Samsung Electronics Co., Ltd., Suwon, Rep. of Korea

[21] Appl. No.: 980,216

[22] Filed: Nov. 23, 1992

[30] Foreign Application Priority Data

Nov. 23, 1991 [KR] Rep. of Korea ..... 91-21018

[51] Int. Cl.[5] ..... D06F 33/02

[52] U.S. Cl. ..... 8/158; 68/22 R

[58] Field of Search ..... 68/12.19, 12.22, 15, 68/16; 8/158

[56] References Cited

U.S. PATENT DOCUMENTS 3,269,154 8/1966 Deiss ..... 68/12.12
4,330,081 5/1982 McMillian ..... 68/12.22 X
4,406,401 9/1983 Nettro ..... 68/12.22
4,528,709 7/1985 Getz ..... 8/158
4,580,421 4/1986 Babuin et al. ..... 68/12.19
4,800,740 1/1989 Huttemann ..... 68/12.19

*Primary Examiner*—Frankie L. Stinson
*Attorney, Agent, or Firm*—Burns, Doane, Swecker & Mathis

[57] ABSTRACT

A water feeding control method for use in a boiling clothes washing machine having a heater for processing clothes with hot water and control for the proper use of warm and cooling water. The water feeding control method includes a step of determining whether either one of wool and boiling wash modes is selected, at least one routine of checking the possibility of the water feeding, sensing the temperature of wash water fed through warm and cooling water feeding valves and storing the sensed temperature in a memory of the control system, and a routine of selecting a water feeding valve suitable for a wash mode based on the resulting data obtainable from the routines.

11 Claims, 4 Drawing Sheets 230
2
IS ANY ONE OF WATER FEEDING VALVES NOT OPERATED ?
231
YES
NO
IS THE WATER TEMPERATURE SUITABLE FOR A WASH MODE ?
232
YES
NO
WARNING ALARM
236
ARE BOTH WATER FEEDING VALVES NOT OPERATED ?
233
YES
WARNING ALARM
237
THE WATER TEMPERATURES ARE COMPARED WITH EACH OTHER AND THE CORRESPONDING WATER FEEDING VALVE IS SELECTED
234
THE CORRESPONDING WASH MODE IS PERFORMED
235
END

WATER FEEDING CONTROL METHOD OF A BOILING CLOTHES WASHING MACHINE

BACKGROUND OF THE INVENTION

The present invention relates to a control method of a boiling clothes washing machine for cleaning clothes with boiling water, and more particularly, to a control method for feeding cold or hot water through a cold water feeding valve and a heating water feeding valve. Herein, a water feeding control method means that the water feeding is performed at a proper temperature through a cold water feeding valve and a hot water feeding valve dependant upon whether the current wash mode complies with the selected wash mode of a cool water wash mode and a warm water wash mode.

Generally, a fully automatic washing machine includes a heater mounted between a tub and a water basin and additional tubes for feeding warm water or cool water through each of cool and warm water feeding valves in order to process clothes under the selected wash mode. The washing machine automatically performs the connection of the cooling water tube to the corresponding valve in order to clean clothes with cool water under the wool wash mode, in which clothes are made of materials such as wool and nylon, etc., having a low thermal resistance temperature.

However, in a case where the warm water feeding valve is erroneously connected to the cool water tube by a user's mistake, and vice versa, damage could happen to clothes such as wool under the wool wash mode. Also, when cool water is mistakenly fed for use in a boiling wash mode, the heater is operated for along time period to heat the cool water under the warm water wash mode, thereby causing unnecessary power consumption. Furthermore, when both valves break down, over-heating of the heater become critical to clothes.

It is an object of the present invention to provide a water feeding control method of a boiling clothes washing machine for feeding wash water having a proper temperature suitable for a wash mode selected independent of the connection state of tubes to warm and cool water feeding valves, so that clothes may be protected. It is another object of the present invention to provide a water feeding control method of a boiling clothes washing machine for feeding wash water having a relatively higher temperature suitable for boiling wash mode selected by connecting of a warm water tube to a warm water feeding valve, so that the power consumption may be minimized.

It is still another object of the present invention to provide a water feeding control method of a boiling clothes washing machine for feeding wash water by selecting a water feeding valve that is usable, so that the water feeding errors may be prevented.

SUMMARY OF THE INVENTION

The present invention concerns the adaptation of a boiling clothes washing machine having a heater for processing clothes with hot water, and particularly centers on the proper use of warm and cool water. According to the present invention, a water feeding control method comprises a step of determining whether any one of wool and boiling wash modes is selected, at least one routine of checking the possibility of the water feeding, sensing the temperature of wash water fed through warm and cool water feeding valves and storing the sensed temperature memory of in a control system, and a routine of selecting a water feeding valve suitable for a wash mode based on the resulting data obtainable from said routines.

It is noted that such a boiling clothes washing machine assures of saving the energy consumption and prevents damage of clothes.

BRIEF DESCRIPTION OF THE DRAWINGS

The present invention will now be explained in detail with reference to the accompanying drawings, in which.

DETAILED DESCRIPTION OF THE INVENTION

Figure 1:
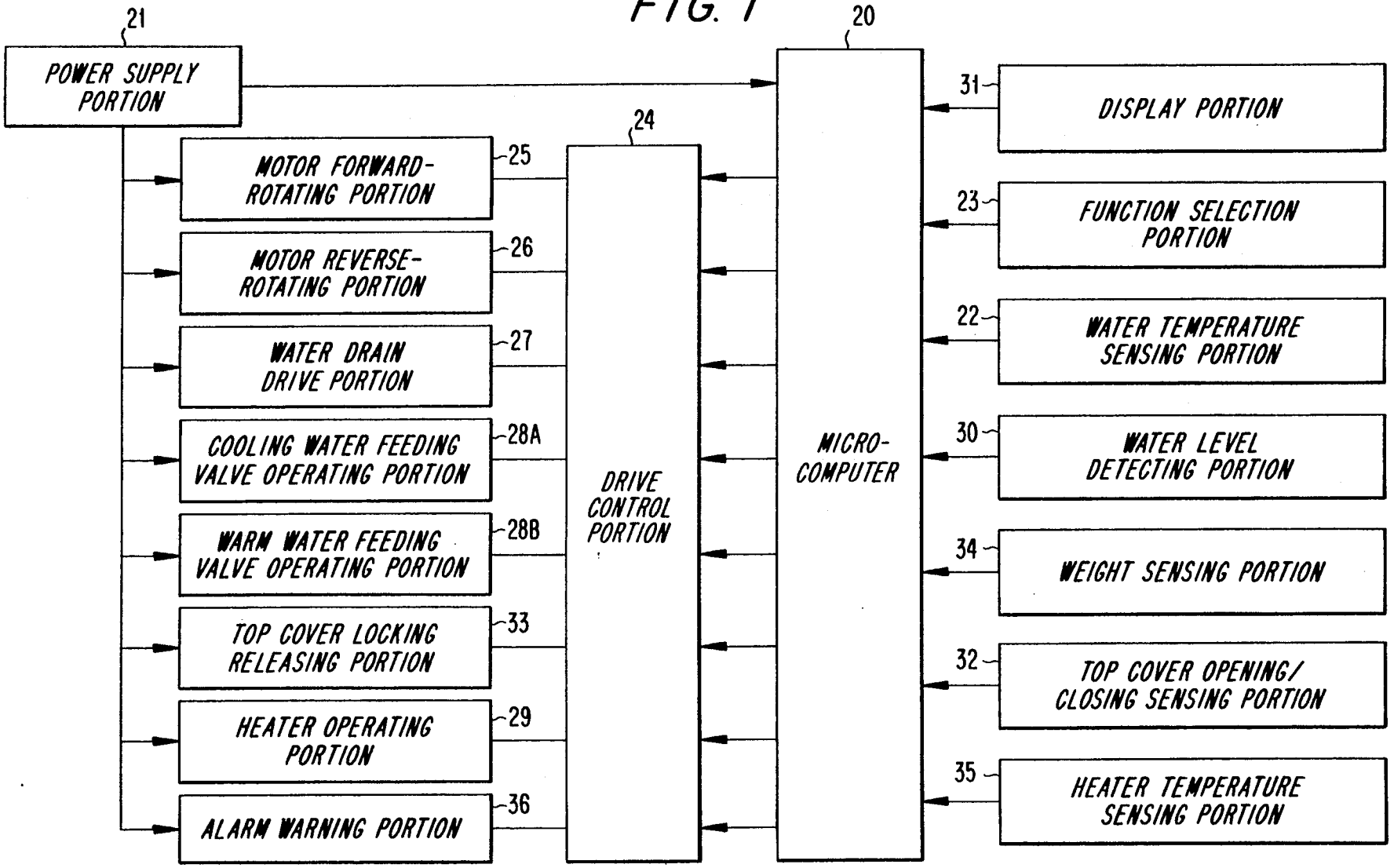
FIG. 1 is a schematic block diagram adapted for use in the control of a boiling clothes washing machine according to the present invention.

Referring to FIG. 1, a control system is schematically illustrated for the purpose of explaining the operation of a boiling clothes washing machine, which is adaptable to a conventional fully automatic washing machine, the detailed explanation of which is omitted.

The control system comprises a micro-computer 20 for controlling the whole operation of the system according to its programming stored therein, and a power supply portion 21 for rectifying an A.C. voltage into a constant voltage for supply to every portion of the system. The control system further comprises a portion 22 for sensing the temperature of wash water fed into a washing basin, a portion 23 for selecting the function corresponding to the operation procedures of the washing machine, and a portion 24 for controlling the operation of loads corresponding to the control signals from the micro-computer 20. Also connected to the drive control portion 24 is a portion 25 for forward-rotating a motor during washing and dehydrating of the washing machine, a portion 26 for reverse-rotating a motor during a washing cycle of the washing machine, a draining driving portion 27 for draining wash water used, driving portions 28A and 28B for feeding warm and cool water into a wash basin, a heater operating portion 29 for heating wash water, a portion 30 for detecting the water level of wash water, and display portion 31 for indicating the selection, operation and completion of wash procedures, a portion 32 for detecting the opening/closing of a top cover of the washing basin, a portion 33 for locking/releasing the top cover, a portion 34 for sensing the weight of clothes to be washed, a portion 35 for sensing the temperature of the heater, and a portion 36 for warning an abnormal state of the system.

Figure 2A:
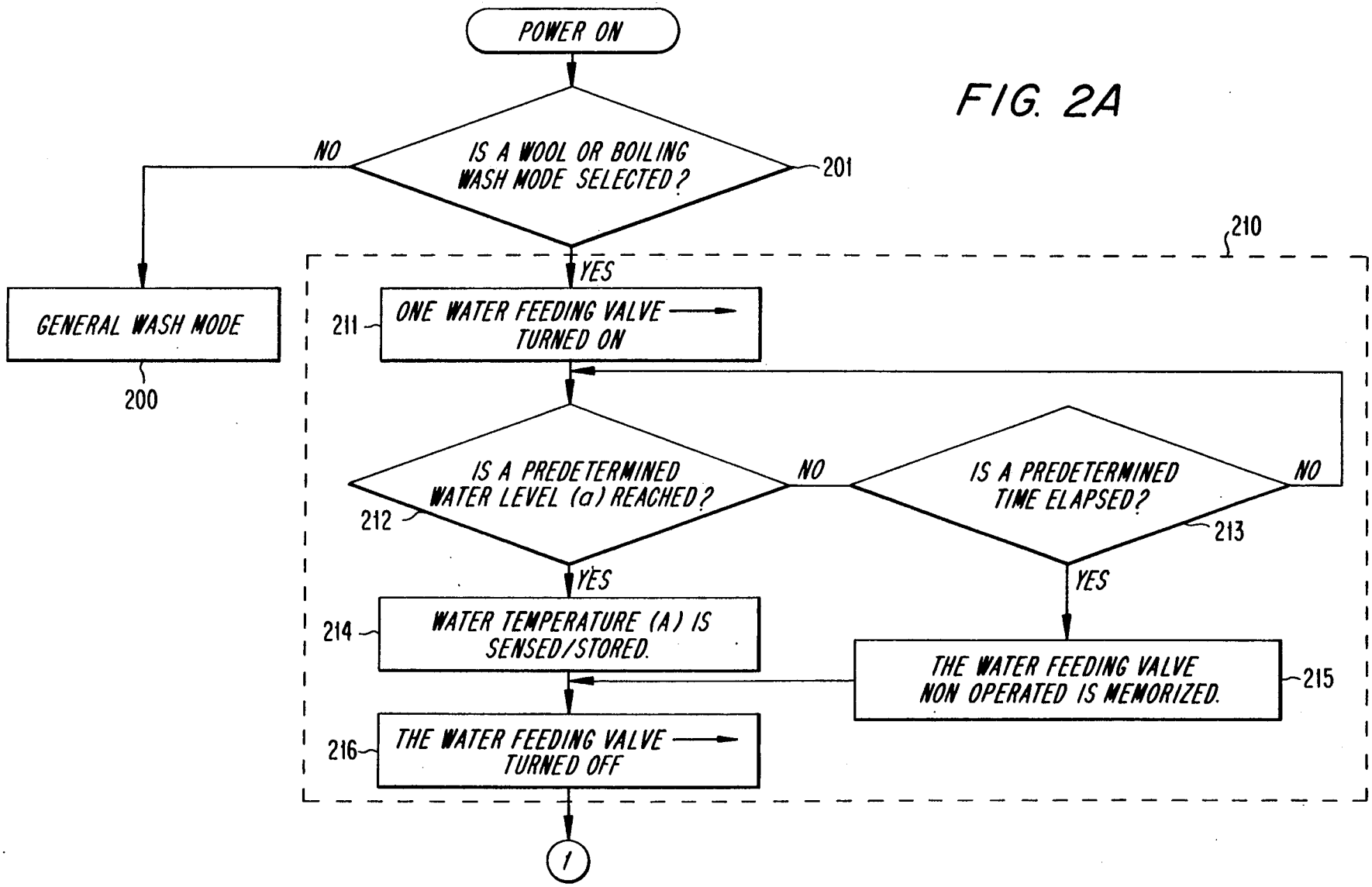
FIGS. 2A, 2B and 2C are flow charts showing a water feeding control method of a boiling clothes washing machine according to the present invention.
Figure 2B:
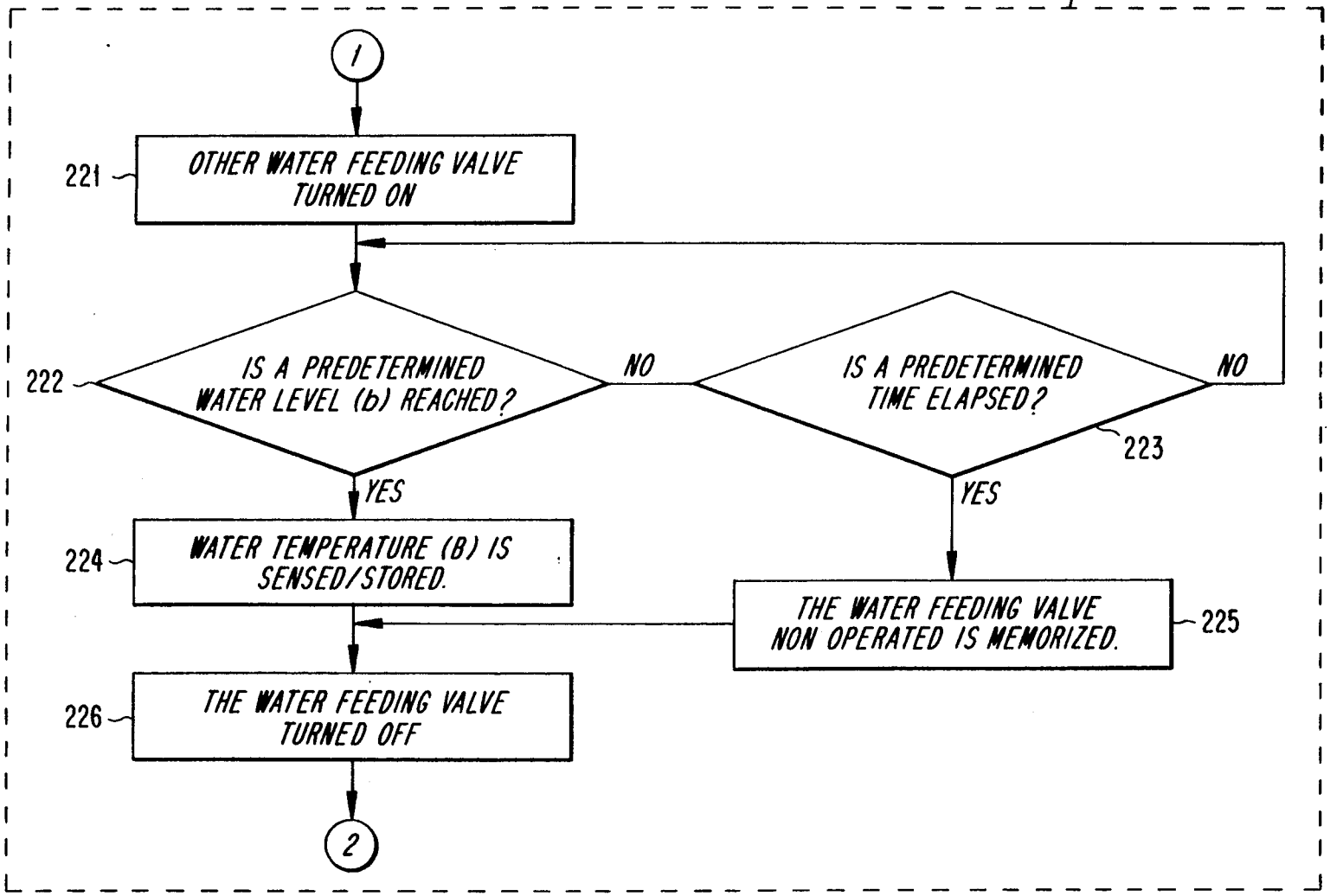
Figure 2C:
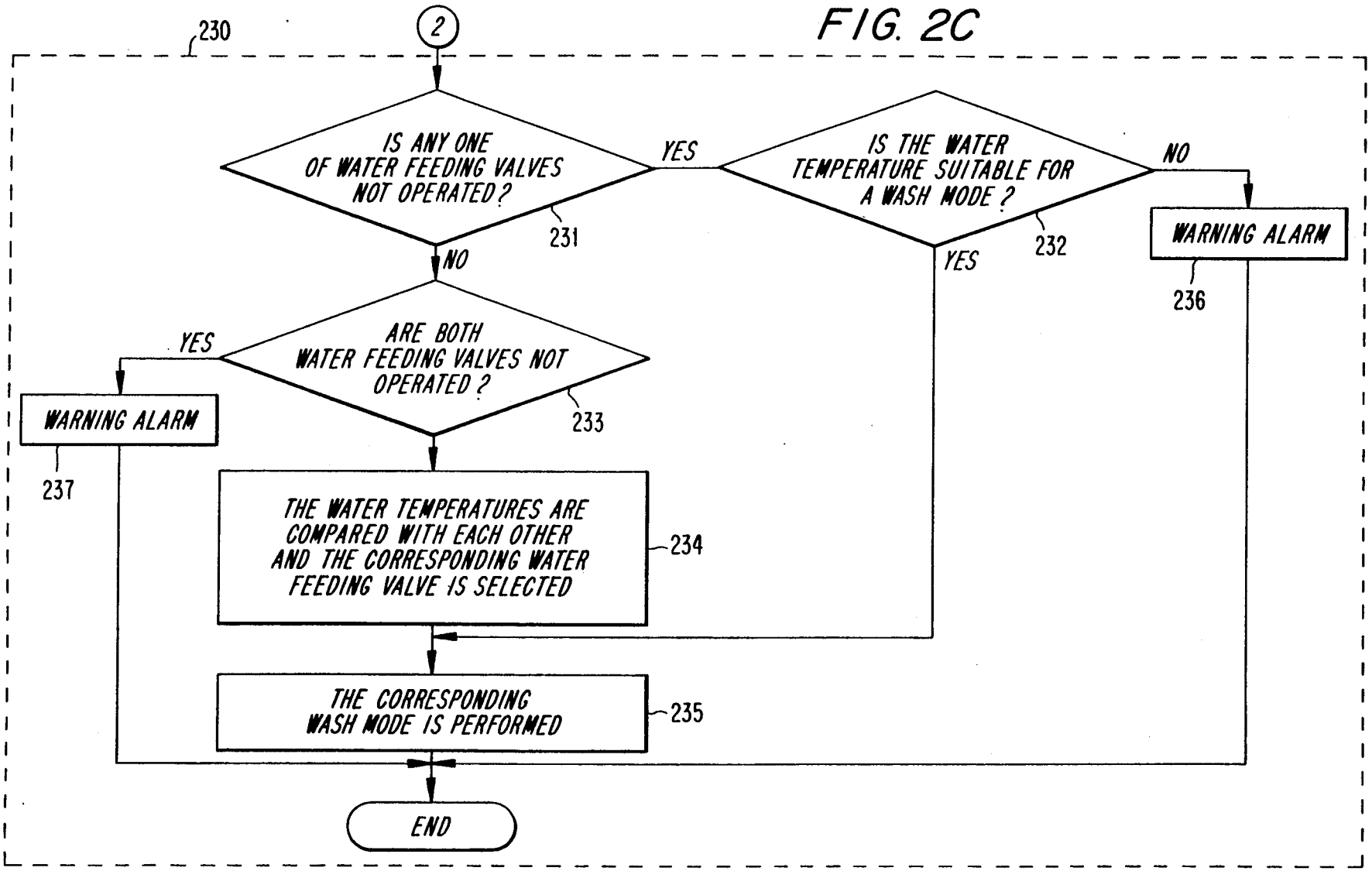

Referring to FIGS. 2A, 2B and 2C, when a control system is tuned on, a control method adapted to boiling clothes washing machine comprises a step 201 of determining whether either one of wool and boiling wash modes is selected, a step 200 of performing a general wash mode if any one of wool and boiling wash modes is not selected, first and second routines 210 and 220 for checking the possibility of water feeding, sensing the temperature of wash water fed through warm and cool water feeding valves and storing the sensed temperature in a memory of a control system if any one of wool and boiling wash modes is selected, and a routine 230 for selecting a water feeding valve suitable for a wash mode based on the resulting data obtainable from first and second routines 210 and 220.

The first water feeding and temperatures sensing routine 210 is performed as follows:

At step 211, one water feeding valve is operated to supply wash water into a washing basin (not shown). Step 211 goes on to step 212 to determine whether wash water has reached a predetermined water level (a). If the water level (a) is sensed, at step 214 the temperature of wash water is sensed/sorted in the memory of the control system. If the water feeding state is below the predetermined water level, step 212 moves to step 213 to determine whether a predetermined water feeding time has elapsed. The water feeding is continued through the valve for the predetermined time period. On the other hand, if a lower water level is maintained after the elapse of the predetermined time, at step 215 data related to the non-operation of the water feeding valve is stored in the memory of the control system. At step 216, the water feeding valve is judged to be in the turned-off condition.

The second water feeding and temperature sensing routine 220 is performed as follows:

At step 221 another water feeding valve is operated to supply wash water into a washing basin (not shown). Step 221 goes on to step 222 to determine whether wash water has reached a predetermined water level (b). If the water level (b) is sensed, at step 214 the temperature of wash water is sensed/stored in the memory of the control system. If the water feeding state is below the predetermined water level (b), step 222 moves to step 223 to determines whether a predetermined water feeding time has elapsed. The water feeding is continued through the valve for the predetermined time period. On the other hand, if a lower water level is maintained after the elapse of the predetermined time, at step 225 data related to the non-operation of the water feeding valve is stored in the memory of the control system. At step 226, the water feeding valve is judged to be in the turned-off condition.

The water feeding valve selecting routine 230 is performed only when it is judged, based on data stored at the first and second water feeding temperature sensing routines 210 and 220, whether one or the other water feeding valve is operated. It is determined at step 231 whether any one of the water feeding valves A and B is not operated. If the non-operated valve is exists, step 231 goes on to step 232 to determine whether the temperature of wash water fed is proper for a wash mode selected by users. If the wash mode selection is correct, the corresponding wash mode is performed. Otherwise, at step 236 an alarm warning is issued in response to the inconsistency between the fed wash water and the selected wash mode. When it is determined at step 231 that one of the water feeding valves has been operated, at step 233 it is determined whether the operation of both water feeding valves is impossible. If impossible, step 233 is skipped, and the routine proceeds to step 277 to generate an alarm warning. If operation of both water feeding valves is possible, step 233 moves to step 234 to compare the wash water temperatures with each other and then operate the corresponding valve corresponding to the selected wash mode for processing clothes.

A control system of a boiling clothes washing machine is operated according to a water feeding control method when a power supply portion 21 is turned on. A wash mode is selected by users through a function selecting portion 23. At that time, it is determined at step 201 whether any one of wool and boiling wash modes is selected. Step 201 goes on to step 200 to perform a general wash mode, for example casual clothes not made of a special fiber, if any one of wool and boiling wash modes is not selected. If wool or boiling wash mode is selected, at step 211 one of the cool and warm water feeding valves is selected by enabling any one of the cool and warm water feeding valve operating portions 28A and 28B to be operated. Next, if it is judged through steps 212 and 213 that the water in the basin has failed to reach a predetermine water level (a) within the elapse of a predetermined time, the micro-computer 20 stores that the water feeding valve is not able to supply wash water. If the predetermine water level (a) is reached the water temperature sensing portion 22 senses the fed water temperature for storage in memory of the micro-computer 20. Thereafter, the water feeding valve is turned off while cool and warm water feeding valve operating portions 28A and 28B are turned-off at step 216.

The second water feeding and temperature sensing routine 220 is performed like the first routing 210 with respect to other water feeding valve.

Therefore, the micro-computer 20 holds data of the water feeding possibilities and the water temperatures related to each of water feeding valves through the first and second water feeding and temperature sensing routines 210 and 220. Next, the second routine 220 proceeds to the water feeding valve selecting routine 230.

First, it is determined based on data of the micro-computer 20 at step 231 whether it is impossible for any one of water feeding valves to supply wash water. If yes, at step 232 it is determined whether the temperature of wash water fed is proper to a wash mode such as a wool wash mode. If the wash water temperature is useful, the corresponding wash mode is performed. Otherwise, at step 236 the micro-computer 20 operates the alarm warning portion 36 to issue the alarm warning in response to the inconsistency between the sensed wash water temperature and the selected wash mode.

Next, if it is determined to be not possible to supply wash water through both water feeding valves, at step 237 the micro-computer 20 generates the alarm warning. If the water feeding is possible through both valves, the microprocessor 20 compares the current temperature of wash water with the temperature sensed at the first or second water feeding and temperature sensing routine 210 or 220 and then operate the corresponding valve related to the wash mode for processing clothes. If the boiling wash mode is selected, the microprocessor 20 determines through the water level detecting portion 30 whether the water level appropriate for the boiling wash mode is reached and operates the heater operating portion 29 while operating the forward and reverse rotating portions 28A and 28B in turn, accompanying a series of washing procedures.

As described above, the present invention may feed wash water having the temperature appropriate for a wash mode selected by users into a water basin independent of an error in the connection of tubes to cool and warm water valves during the performing of a wool or boiling wash mode, thereby preventing damage of clothes such as wool and reducing power consumption due to long periods of operation of a heater during a boiling wash mode.

What is claimed is:

1. A water feed control method for use in a boiling clothes washing machine provided with a heater for processing clothes with hot water, said method comprising the steps of:

determining whether any one of wool and boiling wash modes is selected;

turning on a first water feeding valve connected to a first water supply source;

determining whether or not said first water feeding valve is operable according to whether a predetermined water level has been reached within a predetermined time;

sensing and storing a temperature of wash water fed through said first water feeding valve if said first water feeding valve is determined to be operable;

turning off said first water feeding valve;

turning on a second water feeding valve connected to a second water supply source;

determining whether or not said second water feeding valve is operable according to whether a predetermined water level has been reached within a predetermined time;

sensing and storing a temperature of wash water fed through said second water feeding valve if said second water feeding valve is determined to be operable;

turning off said second water feeding valve; and, selecting/operating said first or said second water feeding valve determined to be operable and having a sensed temperature suitable for a selected wash mode and performing the selected wash mode.

2. A water feed control method according to claim 1, wherein said water feeding valve selecting/operating step includes the steps of:

performing the selected wash mode when only one of said first and second water feeding valves is determined to be operable if the sensed temperature of wash water fed through said operable water feeding valve is suitable for the selected wash mode; and generating the alarm warning when only one of said first and second water feeding valves is determined to be operable if the sensed temperature of wash water fed through said operable water feeding valve is not suitable for the selected wash mode.

3. A water feed control method according to claim 1, wherein said water feeding valve selecting/operating step includes the step of:

generating the alarm warning when neither of said first and second water feeding valves is determined to be operable.

4. A water feed control method according to claim 1, wherein said water feeding valve selecting/operating step includes the step of:

comparing the sensed water temperatures with each other and selecting/operating the water feeding valve feeding wash water having a suitable temperature for the selected wash mode when both of said first and second water feeding valves are determined to be operable.

5. A water feed control method for use in a washing machine comprising the steps of:

determining whether any one of a first special fabric washing mode and a second special fabric washing mode is selected;

turning on a first valve connected to a first water supply source;

determining whether or not said first valve is operable according to whether a predetermined water level has been reached within a predetermined time;

sensing and storing the temperature of the fed water if said first valve is determined to be operable;

turning off said first valve;

turning on a second valve connected to a second water supply source;

determining whether or not said second valve is operable according to whether a predetermined water level has been reached within a predetermined time;

sensing and storing the temperature of the fed water if said second valve is determined to be operable;

turning off said second valve; and selecting/operating said first or said second valve determined to be operable and having a sensed temperature suitable for the selected wash mode and performing the selected wash mode.

6. A water feed control method according to claim 1, wherein said valve selecting/operating step includes the steps of:

performing the selected wash mode when only one of said first and second valves is determined to be operable if the sensed temperature of wash water fed through said operable valve is suitable for the selected wash mode; and generating the alarm warning when only one of said first and second valves is determined to be operable if the sensed temperature of wash water fed through said operable valve is not suitable for the selected wash mode.

7. A water feed control method according to claim 1, wherein said valve selecting/operating step includes the step of:

generating the alarm warning when neither of said first and second valves determined to be is operable.

8. A water feed control method according to claim 1, wherein said valve selecting/operating step includes the step of:

comparing the sensed water temperatures with each other and selecting/operating the valve feeding the wash water having a suitable temperature for the selected wash mode when both of said first and second valves are determined to be operable.

9. A water feed control method according to claim 1, wherein said first and second water sources respectively supply water having temperature ranges different from each other.

10. A water feed control method according to claim 1, wherein said washing machine includes a heater for processing clothes with hot water.

11. A water feed control method according to claim 10, wherein said first special fabric washing mode is a wool washing mode, and said second special fabric washing mode is a boiling washing mode.

* * * * *